United States Patent [19]

Arbour

[11] 4,207,936

[45] Jun. 17, 1980

[54] TEXTURED WOOD SURFACING

[76] Inventor: Raymond L. Arbour, R.F.D. #1, Gardiner, Me. 04345

[21] Appl. No.: 956,484

[22] Filed: Nov. 1, 1978

[51] Int. Cl.[2] ..... B27M 1/08; B27L 11/00

[52] U.S. Cl. ..... 144/320 R; 428/151; 144/309 R; 144/309 D

[58] Field of Search ..... 144/2 R, 309 D, 309 R, 144/310 B, 320 R, 328; 428/141, 167, 169, 151

[56] References Cited

U.S. PATENT DOCUMENTS

| | | | |
|---|---|---|---|
| 2,286,066 | 6/1942 | Deskey . | |
| 2,549,570 | 4/1951 | Bryan . | |
| 2,974,694 | 3/1961 | Elmendorf et al. | 144/320 |
| 3,284,898 | 11/1966 | Hopkins . | |
| 3,331,413 | 7/1967 | Hoffman | 144/309 R |
| 3,791,427 | 2/1974 | Haynes . | |
| 3,957,095 | 5/1976 | Johnson . | |

*Primary Examiner*—George F. Lesmes

*Assistant Examiner*—Daniel R. Zirker

*Attorney, Agent, or Firm*—Daniel H. Kane, Jr.

[57] ABSTRACT

Texturing the surface wood comprising moving randomly positioned, rigidly mounted shredding points along the surface of the wood, orienting the direction of movement of the shredding points generally in the direction of the grain but slightly at variance with the grain, bearing down to engage the shredding points into the grain of the wood, ripping and shredding fragments of the grain as the shredding points cross the grain in the direction slightly at variance with the grain while leaving the shredded fragments still attached to the wood surface at one end, lifting and randomly orienting the shredded fragments of grain still attached to the wood surface as the shredding points move along the surface thereby imparting a rough appearance of randomly oriented grain fragment separations covering the surface.

2 Claims, 7 Drawing Figures

TEXTURED WOOD SURFACING

FIELD OF THE INVENTION

This invention relates to a new and improved method for texturing the surface of wood to provide a rough decorative appearance, a tool for performing the method, and the wood product resulting from the method.

DESCRIPTION OF THE PRIOR ART

A variety of methods and tools have been devised for imparting a "rough cut" appearance to the surface of wood for simulating barn boards, rough sawn or rough hewn lumber, split cedar shake shingles, and similar rustic wood surfaces. For example, the Gilmer U.S. Pat. No. 1,943,597 describes a process for grooving shingles and Melby U.S. Pat. No. 1,634,789 describes a shingle grooving machine for performing such a method. Maurer U.S. Pat. No. 2,244,426 describes an arrangement for forming incisions in veneer and Morden U.S. Pat. No. 1,773,695 describes the use of grooving in wood to mask joints. The famous Deskey U.S. Pat. No. 2,286,068 describes and claims striated plywood panels in which the surface of the outer ply is gouged with a multitude of closely spaced grooves of random depth, parallel to the grain. Other patents are enumerated in the report of *Georgia Pacific Corp. vs. U.S. Plywood Corp.* 258 F2d 124 at 128–129 (2nd Cir. 1958).

In each of the foregoing patents, however, the method or apparatus described is adapted to gouge, groove, or cut the surface with a knife-like tool for making incisions or slits or with a cutting or sawing tool for removing pieces or fragments of wood entirely from the surface. The result is a wood product with incisions across the surface or with slices or gouges of wood removed from the surface. In either case, the desired rough or decorative appearance of the surface is attributable to incisions and indentations or to gouges or grooves of completely removed pieces of wood.

Similarly, a variety of hand tools have been devised for conditioning the surface of wood and similar materials. For example, the Hopkins U.S. Pat. No. 3,284,898, the Fendler U.S. Pat. No. 2,983,943, the Draughn U.S. Pat. No. 2,718,654, and the Bryan U.S. Pat. No. 2,549,570 all describe hand tools for scraping the surface of wood. The tools described in these patents have bearing surfaces formed by a plurality of blades generally in a regularly spaced arrangement and the purpose of these tools is primarily to scrape and smooth the surface rather than impart a rough or decorative appearance.

The Johnson U.S. Pat. No. 3,957,095 describes a hand tool for a different purpose, however. This patent discloses an attachment so that the plane can be used to cut periodic or spaced gouges in the surface of wood to create a rough hewn appearance similar to an adze. This tool is thus used for removing entirely gouges of wood from the surface being conditioned. U.S. Pat. No. 3,703,198 describes an automated apparatus for imparting a simulated adze surface to plywood panels.

The Haynes U.S. Pat. No. 3,791,427 describes a method and automated machine for imparting random elongate furrows to the surfaces of wooden panels to simulate weathered barn wood. While this is the closest prior art patent pertinent to the present invention known to applicant, it is not directed to the concept of the present invention and differs both in structure and function. The apparatus of the Haynes Patent incorporates resilient spikes pivotally mounted to undergo swiveling movement. The spikes forcibly engage the surface of a wood panel and dig random elongate indentations in the surface of the wood panel. Thus, as in all of the prior patents discussed above, the rough appearance of the wood surface is produced only by the grooves, furrows, or indentations.

SUMMARY OF THE INVENTION

It is therefore an object of the present invention to provide a method and apparatus for texturing the surface of wood to impart a layer of randomly oriented wood grain fragment separations over the surface of the wood. Thus, while the rough decorative appearance of the present invention may in part be attributed to grooving and incising of the surface of the wood, it is primarily due to the appearance of a layer of randomly oriented shredded fragments of wood grain still attached to the wood surface at one end.

Another object of the invention is to provide a hand tool and method for ripping and shredding fragments of grain from the surface of wood and for imparting a random orientation to the shredded fragments still attached to the wood.

A further object of the invention is to provide a decorative rustic wood finish and wood product having a rough appearance primarily attributable to a layer of randomly oriented grain fragment separations over the surface of the wood.

In order to accomplish these results, the present invention contemplates providing a method for texturing the surface of wood to impart a layer of randomly oriented grain fragment separations over the surface providing a rough appearance comprising moving randomly positioned, rigidly mounted shredding points along the surface of the wood, orienting the direction of movement of the shredding points generally in the direction of the grain but slightly at variance with the grain, bearing down to engage the shredding points into the grain of the wood, ripping and shredding fragments of the grain as the shredding points cross the grain in the direction slightly at variance with the grain while leaving the shredded fragments still attached to the wood surface at one end, lifting and randomly orienting the shredded fragments of grain still attached to the wood surface as the shredding points move along the surface thereby imparting a rough appearance of randomly oriented grain fragment separations covering the surface.

The invention also contemplates a surface roughing tool for texturing the surface of wood by hand comprising a bottom plate with a plurality of randomly spaced holes formed through the plate, a plurality of elongate shredding points adapted for positioning in the holes with head means wider than the hole to keep them from dropping through, a top plate for positioning over the bottom plate, and means for removably and replaceably securing the plates together to bear upon the heads of the shredding points and rigidly maintain the shredding points when secured and for replacing worn shredding points when removed.

The invention further contemplates a new article of wood for interior and exterior decoration having at least one surface covered with shredded grain fragments still attached at one end to the surface but lifted from the surface and oriented with random direction over the surface of the wood imparting a rough appearance of randomly oriented grain fragment separations.

Other objects, features and advantages of the present invention will become apparent in the following specification and accompanying drawings.

DESCRIPTION OF THE PREFERRED EMBODIMENT

Figure 1:
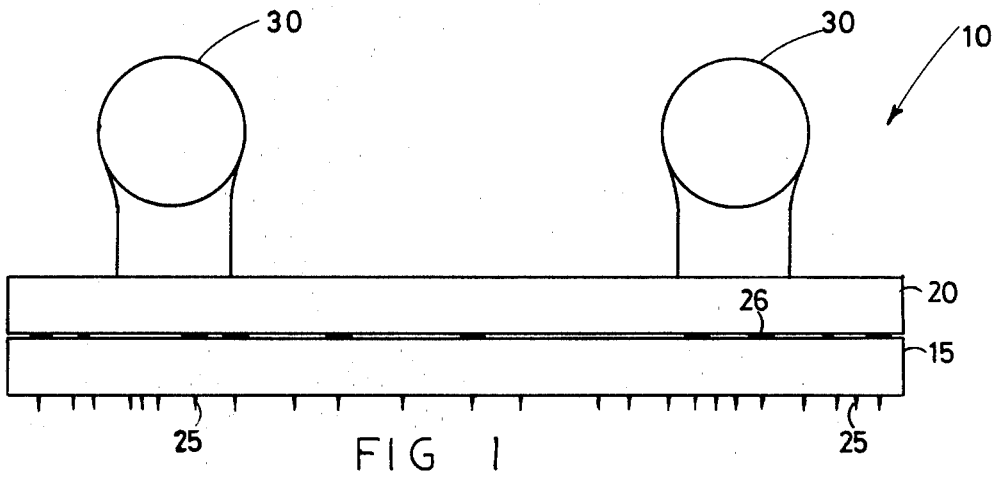
FIG. 1 is a side view of a hand tool for texturing the surface of wood in accordance with the present invention.
Figure 2:
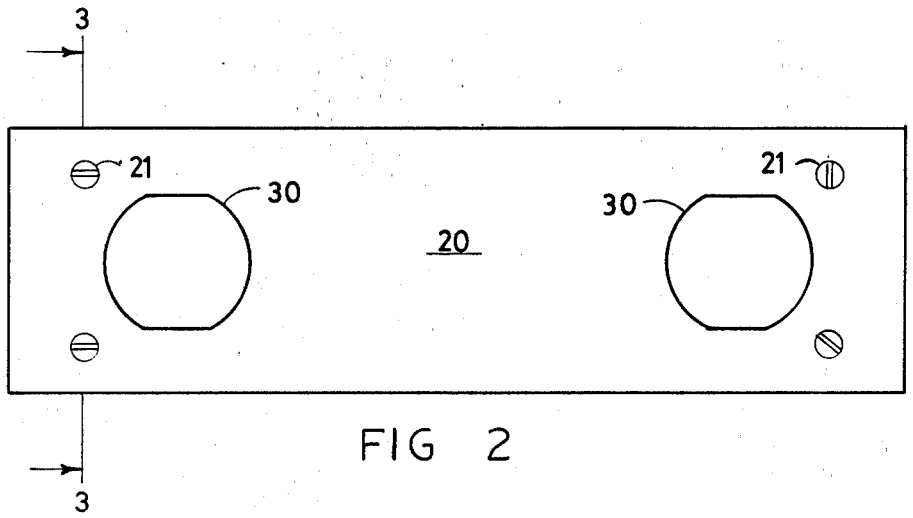
FIG. 2 is a plan view from above of the wood surface texturing tool.
Figure 3:
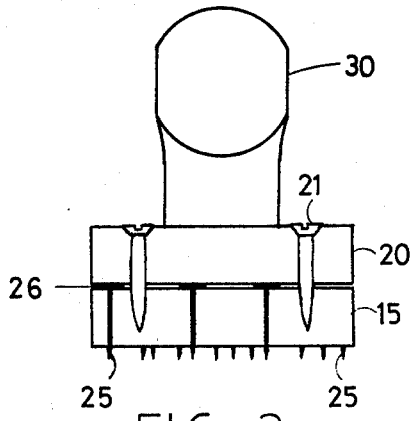
FIG. 3 is an end cross-sectional view of the tool in the direction of the arrows on line 3—3 of FIG. 2.
Figure 4:
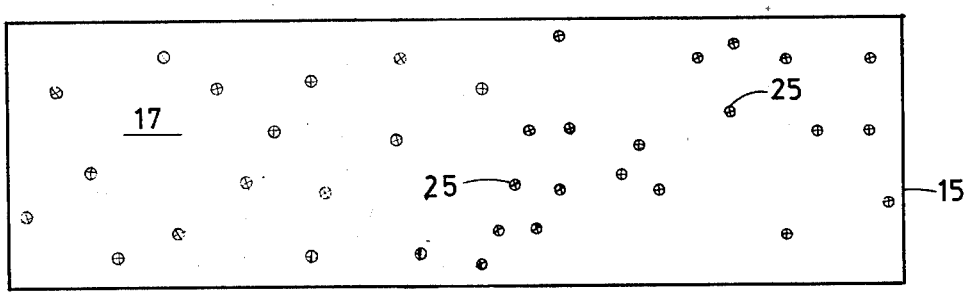
FIG. 4 is a plan view of the bottom bearing surface of the tool showing the random location of the shredding points.
Figure 5:
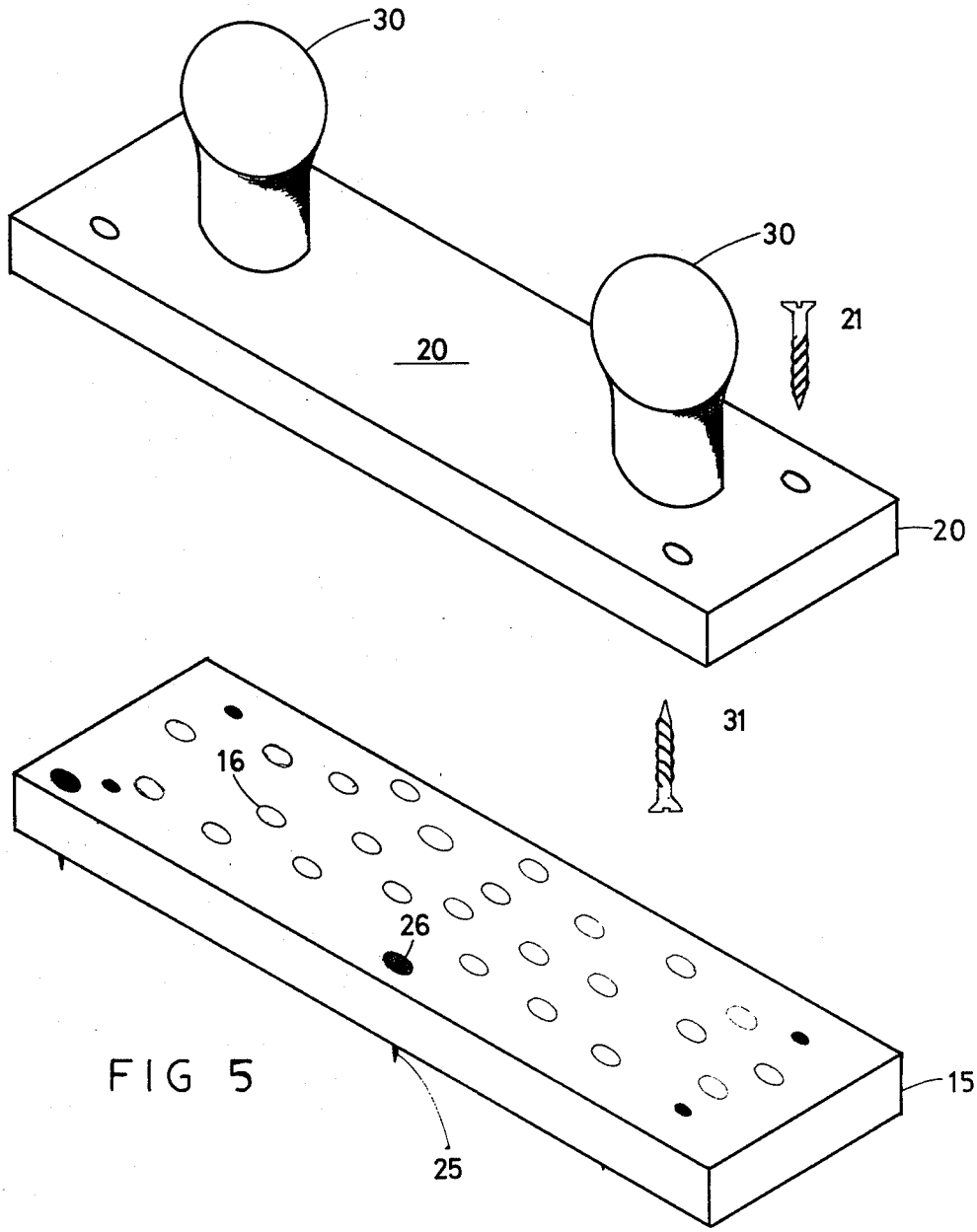
FIG. 5 is an exploded view showing the relationship of the parts of the tool.

A hand tool for manually performing the method and achieving the results of the present invention is illustrated in FIGS. 1–5. Referring simultaneously to all of these illustrations, the tool 10 consists of a bottom plate 15, top plate 20, handles 30, and shredding points 25 seated in holes randomly spaced through the bottom plate 15 and held in place by top plate 20. The bottom plate 15 is thus formed with a plurality of holes 16 through the plate from top to bottom at random positions. The shredding points 25 are seated in the holes 16 and are formed with heads 26 to keep the elongate shredding points from sliding through the holes. A variety to size nails can be used for the shredding points depending upon the type of wood to be textured using the tool, spacing of the grain, hardness of wood etc. The nails or shredding points would be selected to extend a distance, for example, of ⅛ of an inch below the bottom surface 17 of the lower plate 15 although there can be some variation in the length of the shredding points and depth of shredding of the wood surface.

The top plate 20 is fastened securely over the bottom plate 15, for example, by means of screws 21 so that the top plate 20 presses firmly against the heads 26 to secure the shredding points 25 in rigid position. Before securing the top plate 20, the handles 30 can be secured to the top plate, for example, by means of screws 31. The parts of the tool are thus generally separable for replacement of parts and in particular for replacement of the shredding points 25 as they become worn.

The method for texturing the surface of wood according to the present invention is particularly adapted to manual performance because of the attention to the characteristics of the wood and the elements of the method during the operation. The method will be described with reference to the textured wood surfaces of the present invention illustrated in FIGS. 6 and 7. As illustrated in those Figures, there is shown a wood surface 40 with the grain 45 shown in dark lines generally oriented in a vertical direction of FIG. 6 and a horizontal direction going into the paper in FIG. 7. Across the wood surface 40 is a layer of randomly oriented grain fragments 50 which have been shredded from the surface, lifted, and randomly oriented but which are still attached at one end to the grain 45 of the wood surface.

Figure 6:
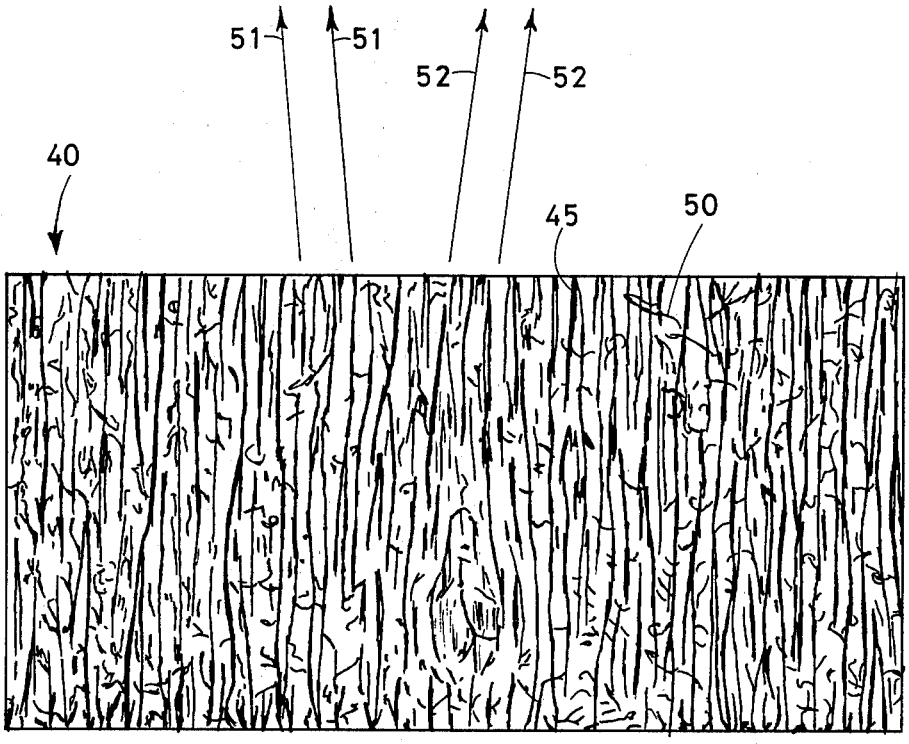
FIG. 6 is a plan view of a textured wood surface for interior and exterior decoration formed in accordance with the present invention and showing the layer of randomly oriented shredded grain fragments still attached at one end to the grain of the wood. The arrows above the wood surface generally show the direction of motion of the tool slightly at variance with the grain to achieve the results of the present invention.
Figure 7:
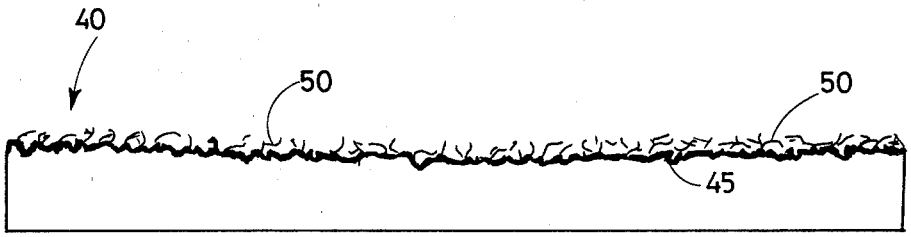
FIG. 7 is a side cross-sectional view of the wood surface of FIG. 6.

In order to achieve the textured wood surface and wood product as illustrated in FIGS. 6 and 7, the tool 10 is placed on the wood surface with the longitudical axis or elongate direction of the tool oriented parallel to the direction of the grain 45 of the surface of the wood. Using the handles 30, the tool is moved along the surface of the wood with the direction of movement generally in the direction of the grain 45 but slightly at variance with the grain in the direction, for example, of the arrows 51 or 52 as illustrated in FIG. 6. During this movement of the tool, the operator bears down upon the tool through handles 30 to engage the shredding points 25 into the grain of the wood. As the engaged shredding points move in the direction slightly at variance with the grain, fragments of the grain are ripped and shredded. As the tool crosses the grain, these fragments are lifted and randomly oriented while still remaining attached to the wood surface grain at one end. This effect can be enhanced or varied to some extent in the operation of the tool by bearing down on the surface during motion and then easing up, and by motion of the tool within a range of angles slightly varying from the general direction of the grain as shown by arrows 51 and 52. The length and characteristic of the randomly oriented fragments can also be varied within limits with slight variation in the angle of variance with the grain direction and in the bearing weight or force of the operator.

While some grooving, incising, or indentation of the surface is inevitable during the texturing operation of the present invention, the most noticeable attribute of the rough appearance of the surface is the distinctive layer or randomly oriented grain fragments contributed by the present invention. A variety of effects can be achieved according to the length, density, and other characteristice of the randomly oriented grain fragments. A most pleasing and dominant grain fragment appearance can be achieved when the direction of the shredded points is controlled within a range at slight variance to the general direction of the grain to produce a major portion of grain fragments in the size range of ⅛ to ¼ inch.

Long term observation of the stability of the textured surface in, for example, a playroom, indicates that it endures over the years without significant loss or shedding of grain fragments. Furthermore, to the extent that dust collects on such a surface, it can be removed by vacuuming also without significant loss of grain fragments over the years while restoring the original appearance. The surface is best treated with a penetrating stain.

The hand method is best suited for softwoods like pine, spruce, and hemlock and might be automated with a power tool for use on harder woods.

I claim:

1. A method for texturing the surface of wood to impart a layer of randomly oriented grain fragment separations over the surface providing a rough appearance comprising:

placing a plurality of randomly distributed but vertically parallel and rigidly mounted pointed shredding nails on the wood surface;

moving the plurality of pointed shredding nails along the surface of the wood generally in the direction of the grain of the wood surface;

bearing down to engage the pointed tips of the shredding nails into the grain of the wood to a depth of approximately one eighth of an inch;

alternately bearing down with sufficient pressure to engage the pointed tips of the shredding nails into the grain of the wood to a depth of approximately one eighth inch and decreasing the bearing pressure;

orienting and controlling the direction of movement and travel of the pointed shredding nails in the general direction of the grain but at a small angle at variance with the grain direction for providing shredded grain fragment separations according to the following steps in the size range of one eighth to one fourth inch in length;

ripping and shredding fragments of the grain as the pointed shredding nails cross the grain with alternately increasing and decreasing bearing pressure and at a small angle slightly at variance to the grain direction, leaving shredded fragments still attached to the wood surface at one end;

lifting and randomly orienting the shredded fragments of grain still attached to the wood surface as the shredding nails move along the surface with increasing and decreasing bearing pressure thereby imparting a rough appearance of randomly oriented grain fragment separations covering the surface; varying the direction of movement of the pointed shredding nails with respect to the grain direction and within a small angular range around the grain direction to provide a spectrum of shredded grain fragment separation lengths from $\frac{1}{8}$ to $\frac{1}{4}$ inch, said angular range varying from a larger angle yielding grain fragment separations of approximately $\frac{1}{8}$ inch in length to a smaller angle yielding grain fragment separations of approximately $\frac{1}{4}$ inch in length.

2. A method for texturing the surface of wood as set forth in claim 1 including the step of vacuuming the surface to restore the textured appearance of the surface.

* * * * *